US007828018B2

(12) United States Patent
Oyama

(10) Patent No.: US 7,828,018 B2
(45) Date of Patent: Nov. 9, 2010

(54) LIGHT DIFFUSING YARN AND SURFACE-FORM STRUCTURE

(75) Inventor: Nobuo Oyama, Tokyo (JP)

(73) Assignee: Kabushiki Kaisha S.T.I. Japan, Tokyo (JP)

( * ) Notice: Subject to any disclaimer, the term of this patent is extended or adjusted under 35 U.S.C. 154(b) by 0 days.

(21) Appl. No.: 12/226,995

(22) PCT Filed: May 1, 2007

(86) PCT No.: PCT/JP2007/059319

§ 371 (c)(1),
(2), (4) Date: Nov. 10, 2008

(87) PCT Pub. No.: WO2007/129644

PCT Pub. Date: Nov. 15, 2007

(65) Prior Publication Data

US 2009/0165883 A1 Jul. 2, 2009

(30) Foreign Application Priority Data

May 10, 2006 (JP) ..... 2006-131517

(51) Int. Cl.
*D03D 15/00* (2006.01)
*D03D 23/00* (2006.01)

(52) U.S. Cl. ..... 139/383 R; 139/420 R; 139/420 A

(58) Field of Classification Search ..... 139/383 R, 139/384 R, 420 R, 426 R, 426 TW, 420 A, 139/383 B See application file for complete search history.

(56) References Cited

U.S. PATENT DOCUMENTS 2,966,775 A * 1/1961 Seem et al. ..... 57/205

(Continued)

FOREIGN PATENT DOCUMENTS

EP 1 326 101 7/2002

(Continued)

OTHER PUBLICATIONS

International Search Report issued Aug. 21, 2007 in the International (PCT) Application of which the present application is the U.S. National Stage.

*Primary Examiner*—Bobby H Muromoto, Jr.
(74) *Attorney, Agent, or Firm*—Wenderoth, Lind & Ponack, L.L.P.

(57) ABSTRACT

Four light-transmitting mono filaments each having an almost circular cross section and surface substantially being mirror surface are arranged in a single layer and in parallel, and a flat yarn formed by fusing or melt-bonding adjacent mono filaments to each other and fixing them is twisted. Twisting is imparted over a full length of a light diffusing yarn continuously at a frequency of more than one time with a length five times as long as the width of the flat yarn. The twisting cyclically reverses the front and rear surfaces of the flat yarn along the longitudinal direction of the light diffusing yarn to continuously change the longitudinal-axis direction of each mono filament along the longitudinal direction of the light diffusing yarn. Therefore, when parallel lights enter the light diffusing yarn, the center axis directions of conical-surface-like diffused lights differ from each other according to individual portions in the longitudinal direction of the light diffusing yarn even if the incident angle of the parallel lights is constant to produce wide-range diffusion light at one cycle of twisting.

20 Claims, 12 Drawing Sheets

U.S. PATENT DOCUMENTS

| | | | | |
|---|---|---|---|---|
| 3,109,220 | A * | 11/1963 | McKinney et al. | 442/196 |
| 3,388,198 | A * | 6/1968 | Sims | 264/177.13 |
| 4,408,260 | A * | 10/1983 | Miedel | 362/576 |
| 5,107,637 | A * | 4/1992 | Robbins | 52/28 |
| 6,382,825 | B1 * | 5/2002 | Wainwright | 362/576 |
| 6,913,454 | B2 * | 7/2005 | Schwar | 425/508 |
| 6,966,673 | B1 * | 11/2005 | Oyama | 362/291 |
| 7,165,311 | B2 * | 1/2007 | Schwar | 29/505 |
| 7,167,627 | B2 * | 1/2007 | Schwar | 385/137 |
| 7,455,427 | B1 * | 11/2008 | Freeman | 362/249.16 |
| 2004/0111842 | A1 * | 6/2004 | Imai | 24/381 |
| 2005/0181695 | A1 * | 8/2005 | Yoshimura et al. | 442/286 |
| 2005/0202741 | A1 * | 9/2005 | Onodera et al. | 442/189 |
| 2005/0217037 | A1 * | 10/2005 | Negola | 8/401 |
| 2007/0037462 | A1 * | 2/2007 | Allen et al. | 442/5 |
| 2009/0159149 | A1 * | 6/2009 | Karayianni et al. | 139/425 R |

FOREIGN PATENT DOCUMENTS

| | | |
|---|---|---|
| JP | 11-43838 | 2/1999 |
| JP | 2002-13040 | 1/2002 |
| JP | 2002-81275 | 3/2002 |
| JP | 2002-115142 | 4/2002 |
| JP | 2004-36039 | 2/2004 |
| JP | 2006-73366 | 3/2006 |

* cited by examiner

LIGHT DIFFUSING YARN AND SURFACE-FORM STRUCTURE

TECHNICAL FIELD

The present invention relates to a light diffusing yarn and a surface-form structure, in particular, a light diffusing yarn and a surface-form structure that are superior in light diffusion characteristics.

BACKGROUND ART

As shown in FIG. 17, as a curtain material introducing external light into a room, there is produced and utilized a cloth woven by using a strip in which approximately 30 flat yarns are held in a plurality of layers and in a flat form, each flat yarn being produced by laterally arranging four mono filaments of a substantially circular sectional configuration and connecting them together through fusion or melt-bonding.

Further, Patent Documents 1 through 3, based on patent applications filed by the present applicant, disclose a light distribution control device using a "structure having a number of ridges arranged parallel to and sufficiently close to each other, wherein the section taken in a direction orthogonal to the longitudinal direction of each of the ridges substantially constitutes a part of a circle, and wherein the surfaces of the ridges are substantially mirror surfaces." Further, Patent Document 3 discloses the provision of a "light diffusion characteristic" in which "light incident on a row of such ridges is diffused in a conical-surface-like fashion in the case of a light transmitting body and in a semi-conical-surface-like fashion in the case of a light reflecting body around a line passing the incident point and parallel to the ridges, with the diffused light density distribution tending to become uniform as the ridge width decreases".

Further, Patent Documents 1 and 2 disclose a transparent body including a fabric into which a large number of mono filaments are woven.

Patent Document 1: JP 2000-17760 A

Patent Document 2: JP 2002-81275 A

Patent Document 3: JP 2006-73366 A

DISCLOSURE OF THE INVENTION

Problem to be Solved by the Invention

Both the mono filaments and the ridges used in the above-mentioned curtain material and the cloth disclosed in Patent Documents 1 and 2 are linearly extended, and hence the distribution of incident sunlight in the room greatly depends on the position of the sun at a given point in time, with the light distribution in the room greatly varying with the daily movement of the position of the sun.

Further, the above-mentioned curtain material and the cloth disclosed in Patent Documents 1 and 2 use the above-mentioned strips or bundles of mono filaments as the warps and wefts, with each weft alternately passing the front and back sides of the warps warp by warp, and each warp alternately passing the front and back sides of the wefts weft by weft. In this mode of weaving, the interval between the adjacent warps and the interval between the adjacent wefts are rather large, with clearances being easily formed at the weaving meshes.

Thus, when a fabric woven in this manner is used as the curtain to introduce light, the amount of direct sunlight entering the room through the clearances at the weaving meshes is rather large, resulting in a dazzling sunbeam being introduced into the room.

The present invention has been made with a view toward solving the above problem in the prior art. It is an object of the present invention to provide a surface-form structure capable of realizing uniform light distribution even if the incident angle varies.

Another object of the present invention is to provide a light diffusing yarn applicable to such a surface-form structure.

Still another object of the present invention is to provide a surface-form structure capable of reducing glare while effecting light distribution.

Means for Solving the Problems

The present light diffusing yarn having a predetermined diameter or width and exhibiting light transmission property or light reflection property, wherein the light diffusing yarn has on its surface a plurality of ridges arranged substantially in parallel and close to each other, wherein each ridge has a cross section constituting at least a part of a circle and has a surface substantially including a mirror surface, and wherein twisting is imparted to the light diffusing yarn at a frequency of more than one time in a length of five times as long as the predetermined diameter or width.

In this case, the expression: "substantially including a mirror surface" can be defined as follows.

As is known, incident light on a predetermined structure surface whose surface asperity is sufficiently smaller than the wavelength of light undergoes mirror reflection, whereas it undergoes diffused reflection when the surface asperity is substantially equal to or larger than the wavelength of light. A surface causing mirror reflection is generally referred to as a "mirror surface".

In the case in which most of a surface of an object is formed by a "mirror surface" or "mirror surfaces" dispersed substantially uniformly, a surface is defined as a "substantial mirror surface" when the ratio of the total area of the mirror surface portions with respect to the area of a predetermined surface (referred to as mirror surface ratio) is to be regarded within a reasonable range for the intended use of the surface. For example, from the viewpoint of the function required thereof, a mirror must cause the major portion of incident light to undergo mirror surface reflection. In this case, the mirror surface ratio will be 0.9 or more.

The ridges may be formed by mono filaments exhibiting light transmission property or light reflection property and having a substantially circular cross section.

A plurality of mono filaments may form a flat yarn arranged in a single layer or a plurality of layers and in parallel and fixed to each other, and the flat yarn may be twisted. Furthermore, a plurality of flat yarns may be twisted together.

Also, a plurality of mono filaments may be twisted together in a bundled state or knitted together.

In a first surface-form structure according to the present invention, the above-mentioned light diffusing yarns are woven or knitted thereinto as at least one of the warps and the wefts.

In a second surface-form structure according to the present invention, the above-mentioned light diffusing yarns are sewn, woven, or embroidered into a surface-form support member.

In a third surface-form structure according to the present invention, a large number of light diffusing yarns as described above are held substantially in parallel and close to each other.

In this case, the large number of light diffusing yarns may be arranged on and fixed to a surface-form support member.

The present fourth surface-form structure is a surface-form structure into which yarns with light diffusion property having on their surfaces a plurality of ridges each of which has a cross section constituting at least a part of a circle and has a surface including a substantially mirror surface and which are arranged substantially in parallel and close to each other, are woven or knitted as at least one of warps and wefts, wherein each warp alternately passes the front and back sides of the wefts for each set of a plurality of wefts, and wherein each weft alternately passes the front and back sides of the warps for each set of a plurality of warps. The phase in which each weft alternately passes the front and back sides of the warps may be shifted by a predetermined number of warps for each set of adjacent wefts, or the phase in which each warp alternately passes the front and back sides of the wefts may be shifted by a predetermined number of wefts for each set of adjacent warps. In this case, the ridges of the yarns with light diffusion property may be formed by light transmitting or light reflecting mono filaments with a substantially circular cross section. A plurality of mono filaments may form flat yarns by arranging them in a single layer or a plurality of layers and in parallel and fixed to each other, or yarns twisting such arrangement of mono filaments may be used. The roles of wrap and weft may be changed. As a yarn with light diffusion property, a light diffusing yarn may be used.

The first to fourth surface-form structure may exhibit a cloth-like flexibility or a plate-like rigidity.

Effects of the Invention

According to the present invention, it is possible to provide a light diffusing yarn superior in light diffusion characteristics, and by using this light diffusing yarn, it is possible to provide a surface-form structure capable of realizing uniform light distribution even if the incident angle varies.

Further, the yarns with light diffusion property are woven in or knitted in as at least one of the warps and the wefts such that each warp alternately passes the front and back sides of the wefts for each set of a plurality of wefts and that each weft alternately passes the front and back sides of the warps for each set of a plurality of warps, whereby the clearances at the weaving meshes or the knitting meshes are reduced, making it possible to reduce glare while effecting light distribution.

DETAILED DESCRIPTION OF THE INVENTION

In the following, embodiments of the present invention are described with reference to the accompanying drawings.

The present inventor test-produced light diffusion structures with ridges by using optical fibers and round bars of various diameters to examine the light distribution of diffused light, from which it was discovered that when the curved edges of the section a large number of ridges arranged in parallel and sufficiently close to each other are arcs, and the surfaces of the ridges substantially include mirror surfaces, light A impinging on a certain point i on the surface of the structure, in both reflection and transmission, is diffused in the form of a conical surface whose apex is i due to the diffraction effect of the row of the above-mentioned ridges, and that, of this diffused light beam, the diffused reflection light beam expands in the form of a longitudinal half of the conical surface, with the diffused transmission light beam expanding in the form of the remaining longitudinal half of the conical surface.

Figure 1:
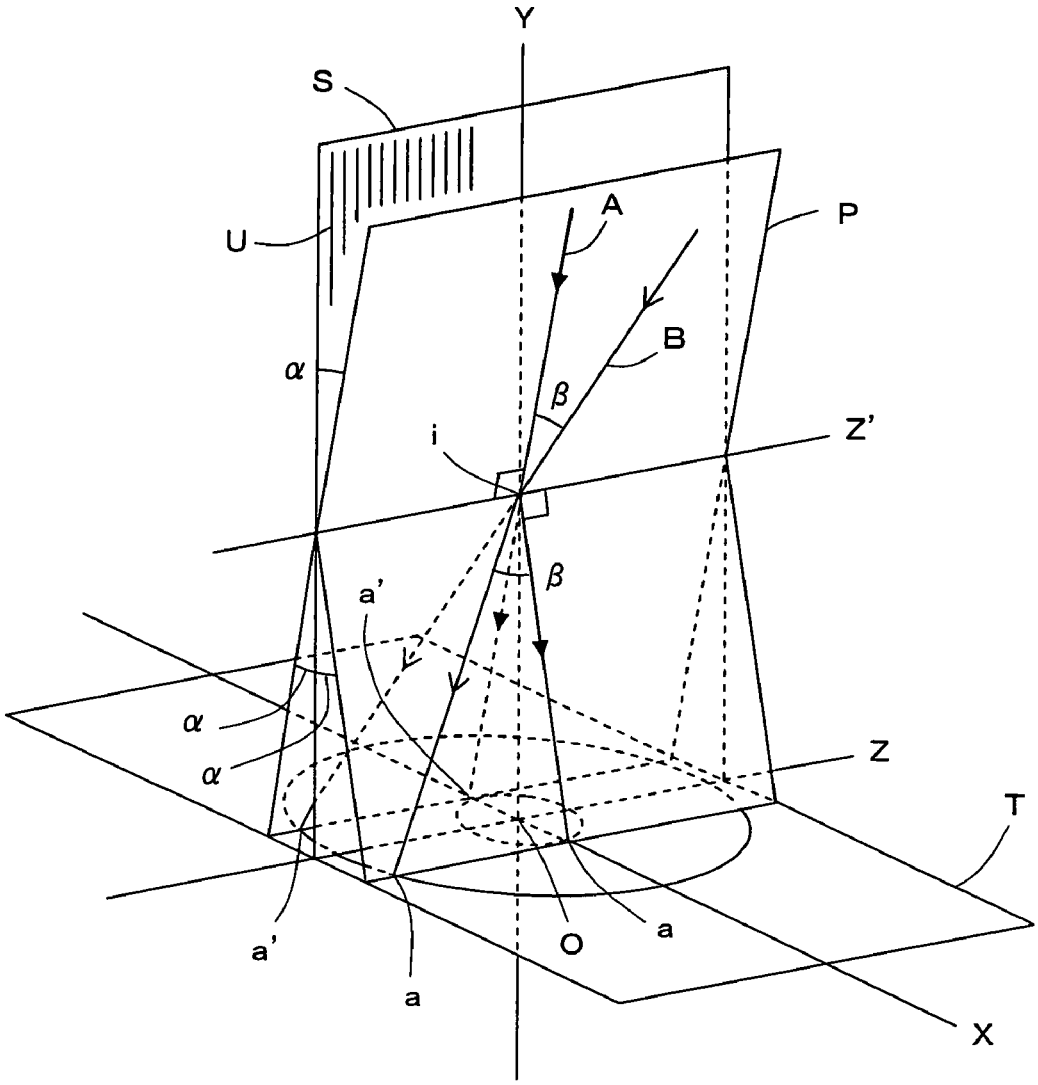
FIG. 1 is a diagram for illustrating the principle of the present invention.

Such a conical-surface-like diffusion further exhibits the following characteristics. First, as shown in FIG. 1, an orthogonal coordinate system is assumed in which a straight line passing the point i and parallel to the longitudinal direction of the ridges U is the Y-axis, with the X-axis and the Z-axis being orthogonal thereto. In this orthogonal coordinate system, when the thickness of the planar structure is neglected, the YZ-plane constitutes the structure. This plane is referred to as the plane S, and the XZ-plane which is orthogonal to the Y-axis at the coordinate origin O below the point i is referred to as the plane T, and an axis passing the point i and parallel to the Z-axis is referred to as the Z'-axis, and a plane containing the Z'-axis and crossing the plane S at an acute angle $\alpha$ is referred to as the plane P.

The light A advances in the plane P and impinges on the plane S at the point i. Assuming that the plane S is a mirror surface, the reflected light and the transmitted light cross the plane T at points a and a', respectively, and the respective halves of the circle whose radius is the segment Oa, Oa' connecting the points a and a' with the origin O, are the sections of the diffused reflection light beam and the diffused transmission light beam of the light A taken along the plane T. In this case, as in the case of incident light B on the plane S of the structure, as the acute angle $\beta$, at which it crosses the XY-plane passing the incident point i, parallel to the ridges U, and orthogonal to the plane S, increases, the expansion of the diffused light beam increases.

Further, assuming that the plane S is a flat mirror surface, the luminance of the diffused light beam in the diffusing direction is maximum in the directions of the reflected light and the transmitted light. Further, as the maximum value directions are departed from, the luminance is reduced in a certain uniform relationship with the angle with respect to the maximum value directions. This luminance distribution in the diffusing direction of the diffused light beam (hereinafter referred to as the diffused light beam luminance distribution) can be turned into a more uniform distribution through appropriate selection of the angle of circumference and maximum diameter of the ridge sections and the proximity degree between the ridges.

As an example of such appropriate selection, the angle of circumference of the ridge sections and the interval between the ridges were varied in different ridges whose respective radiuses were 1 mm, 0.5 mm, and 0.125 mm, and the permissible range in terms of the performance of a light distribution control device in the application fields for the present invention described below was evaluated by a total of three persons: an engineer H1; a market developer H2; and a staff member H3 to be in charge of sales. The evaluation results are shown in Table 1. The evaluation was made in three levels: 1: applicable; 2: applicable depending on the use; and 3: difficult to apply.

TABLE 1

| Radius of Ridge | Angle of Circumference | Interval between Ridges | Evaluation H1 | H2 | H3 |
|---|---|---|---|---|---|
| 1 mm | 160° | about 5 μm | 2 | 2 | 2 |
| | | about 10 μm | 2 | 3 | 2 |
| | | about 100 μm | 3 | 3 | 3 |
| | 140° | about 5 μm | 3 | 2 | 3 |
| | | about 10 μm | 2 | 3 | 3 |
| | | about 100 μm | 3 | 3 | 3 |
| 0.5 mm | 160° | about 5 μm | 1 | 1 | 2 |
| | | about 10 μm | 1 | 2 | 2 |
| | | about 100 μm | 3 | 3 | 2 |
| | 140° | about 5 μm | 1 | 2 | 2 |
| | | about 10 μm | 2 | 2 | 2 |
| | | about 100 μm | 3 | 3 | 3 |
| 0.125 mm | 160° | about 5 μm | 1 | 1 | 1 |
| | | about 10 μm | 1 | 2 | 1 |
| | | about 100 μm | 3 | 3 | 3 |

EMBODIMENT 1

Figure 2:
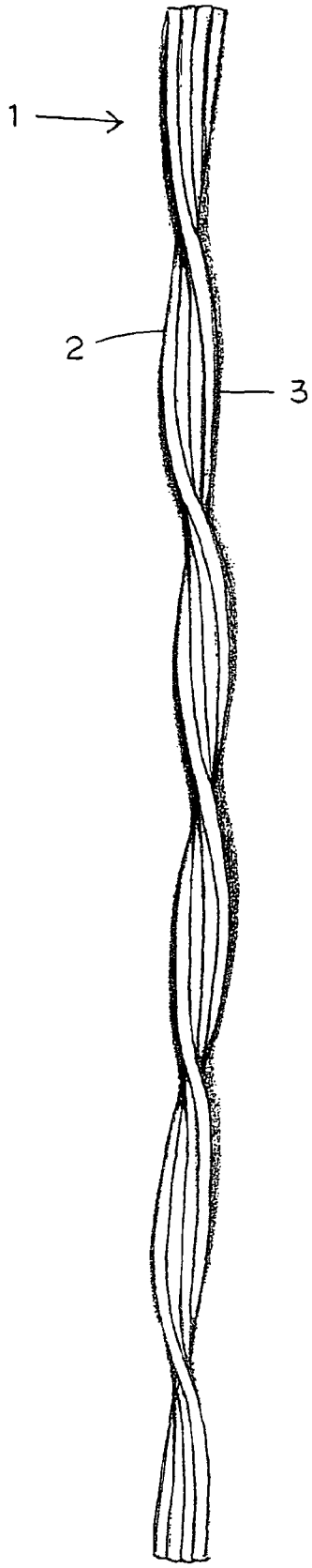
FIG. 2 is a diagram showing a light distributing yarn according to Embodiment 1.
Figure 3:
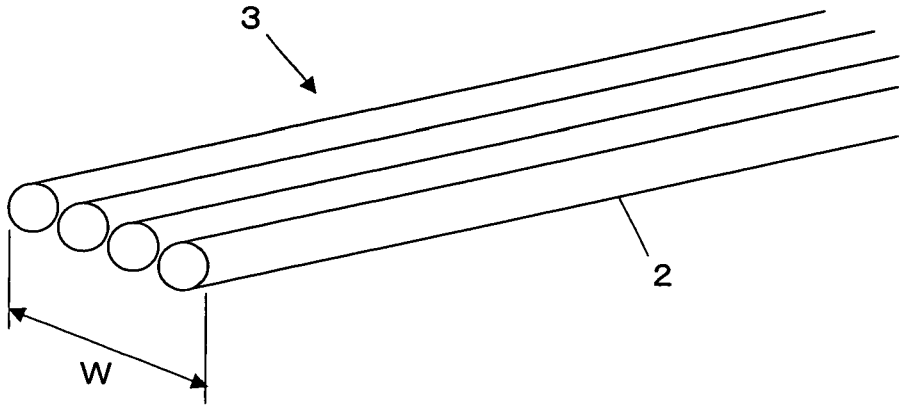
FIG. 3 is a perspective view of a flat yarn used in Embodiment 1.

FIG. 2 shows a light diffusing yarn 1 according to Embodiment 1. The light diffusing yarn 1 is obtained by twisting a flat yarn 3, which is formed, as shown in FIG. 3, by fixing to each other four adjacent light-transmitting mono filaments 2 having a substantially circular cross section and arranged in a single layer and in parallel by fusing or melt-bonding. In this regard, the twisting is imparted to the flat yarn at a frequency of more than one time in a length of five times as long as the width W of the flat yarn 3. In the light diffusing yarn 1 shown in FIG. 2, the twisting is imparted at a frequency of substantially one time in a length of four times as long as the width W of the flat yarn 3.

The surface of each mono filament 2 substantially includes a mirror surface, and the four mono filaments 2 form the ridges of the present invention. The mono filaments 2 can be formed of thermoplastic polymer or the like.

This twisting is imparted continuously over the entire length of the light diffusing yarn 1. The twisting cyclically reverses the front and back surfaces of the flat yarn 3 along the longitudinal direction of the light diffusing yarn 1. More specifically, the twisting reverses the front and back surfaces approximately one time in a length of four times as long as the width W of the flat yarn 3, with the longitudinal-axis direction of each mono filament 2 being continuously changed along the longitudinal direction of the light diffusing yarn 1. Thus, the direction of the center axis of the conical-surface-like diffused light due to each mono filament 2 described with reference to FIG. 1 also changes continuously and cyclically along the longitudinal direction of the light diffusing yarn 1. Thus, for example, in the case where parallel lights enter the light diffusing yarn 1, even when the incident angle of the parallel lights is constant, the center axis directions of conical-surface-like diffused light differ from each other according to individual portions in the longitudinal direction of the light diffusing yarn 1, making it possible to produce wide-range diffused light at one cycle of twisting.

As the degree of twisting imparted to the flat yarn 3 is enhanced, the longitudinal-axis direction of each mono filament 2 is more greatly changed along the longitudinal direction of the light diffusing yarn 1, and hence the diffused light is emitted over a wider range.

For example, when approximately one twist is imparted in a length of double the width W of the flat yarn 3, the directions of the mono filaments 2 at both ends in the width direction of the flat yarn 3 are substantially orthogonal to each other, and the light entering the light diffusing yarn 1 is diffused in substantially all the directions at one cycle of twisting.

Figure 4:
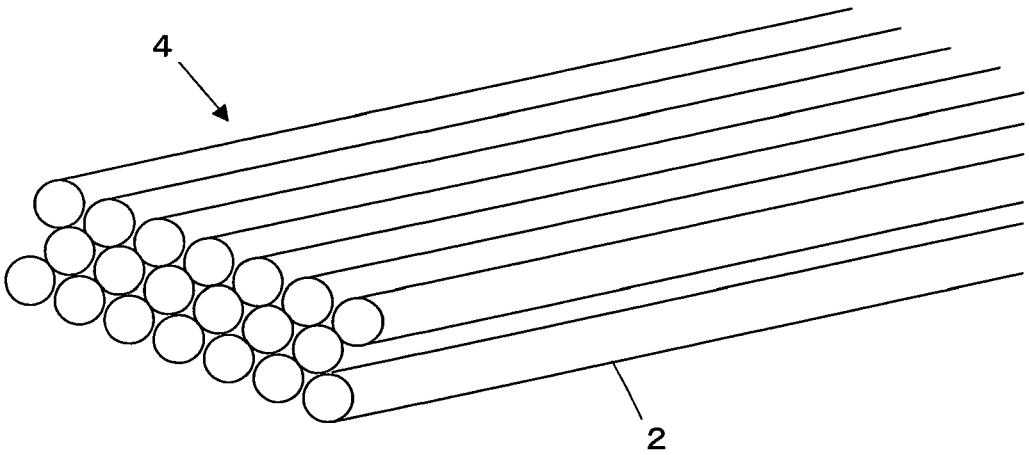
FIG. 4 is a perspective view of a flat yarn used in a modification of Embodiment 1.

The number of mono filaments 2 is not restricted to four, and the flat yarn 3 may be formed by arranging a plurality of mono filaments 2 in parallel. Further, instead of arranging a plurality of monofilaments 2 in a single layer, it is also possible, as shown in FIG. 4, to arrange the mono filaments in parallel in a plurality of layers and fix them to each other to form a flat yarn 4, which is then twisted.

EMBODIMENT 2

Figure 5:
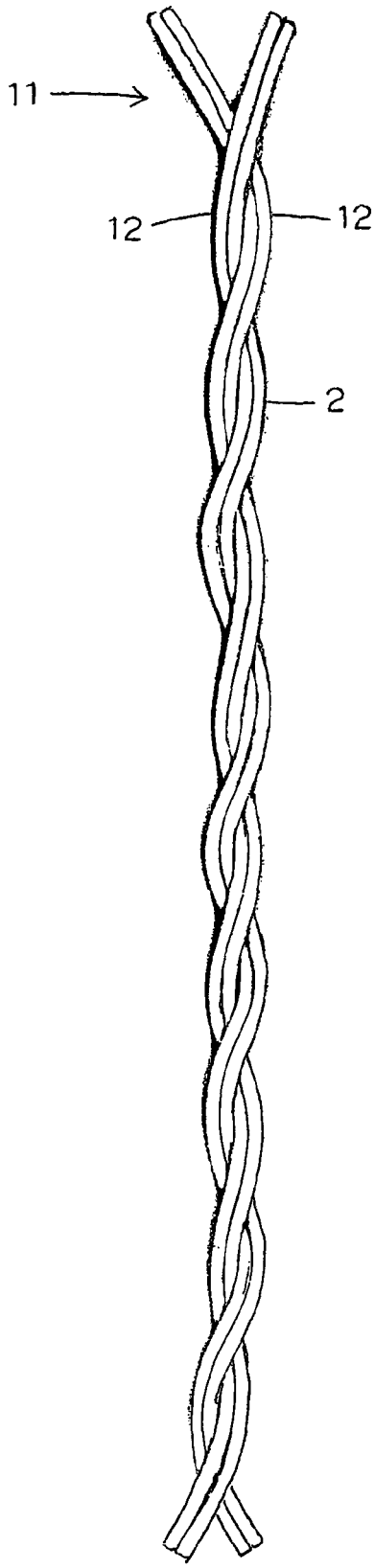
FIG. 5 is a diagram showing a light distributing yarn according to Embodiment 2.

FIG. 5 shows a light diffusing yarn 11 according to Embodiment 2. As in Embodiment 1, in the light diffusing yarn 11, two mono filaments 2 are arranged in parallel and fixed together by fusion or melt-bonding to thereby form a flat yarn 12, and two such flat yarns 12 are twisted together. At this time, twisting is imparted at a frequency of more than one time in a length of five times as long as the entire width of the two flat yarns 12 twisted together. In the light diffusing yarn 11 shown in FIG. 5, twisting is imparted at a frequency of approximately one time in a length of four times as long as the entire width of the two flat yarns 12.

Also in the light diffusing yarn 11, the longitudinal-axis direction of each mono filament 2 changes continuously and cyclically along the longitudinal direction of the light diffusing yarn 11, and the same effect as that of the light diffusing yarn 1 of Embodiment 1 is obtained.

The flat yarn 12 is not restricted to the construction in which two mono filaments 2 are arranged side by side. As shown in FIG. 3, it is also possible to use a flat yarn in which four or some other number of mono filaments 2 are arranged in parallel. Further, it is also possible to use a flat yarn in which a plurality of mono filaments 2 are arranged in parallel in a plurality of layers and fixed together.

EMBODIMENT 3

Figure 6:
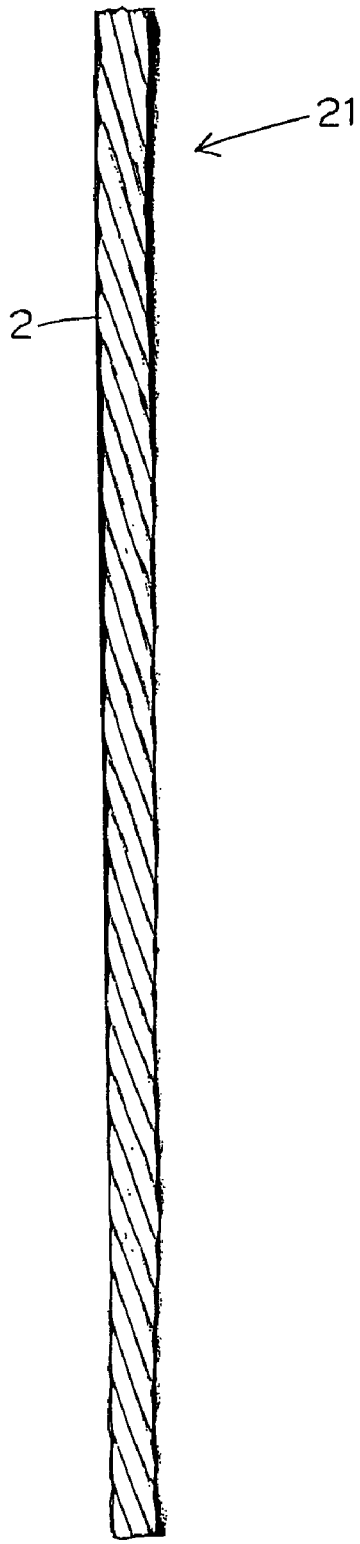
FIG. 6 is a diagram showing a light distributing yarn according to Embodiment 3.

FIG. 6 shows a light diffusing yarn 21 according to Embodiment 3. In the light diffusing yarn 21, a plurality of mono filaments 2 are bundled and twisted together in a cord-like fashion. At this time, twisting is imparted at a frequency of more than one time in a length of five times as long as the diameter of the light diffusing yarn 21.

Also in the light diffusing yarn 21, the longitudinal-axis direction of each mono filament 2 changes continuously and cyclically along the longitudinal direction of the light diffusing yarn 21, and the same effect as that of the light diffusing yarns 1 and 11 of Embodiments 1 and 2 is obtained.

It is also possible to bundle and twist together a plurality of flat yarns in each of which a plurality of single yarns 2 are arranged in parallel.

EMBODIMENT 4

Figure 7:
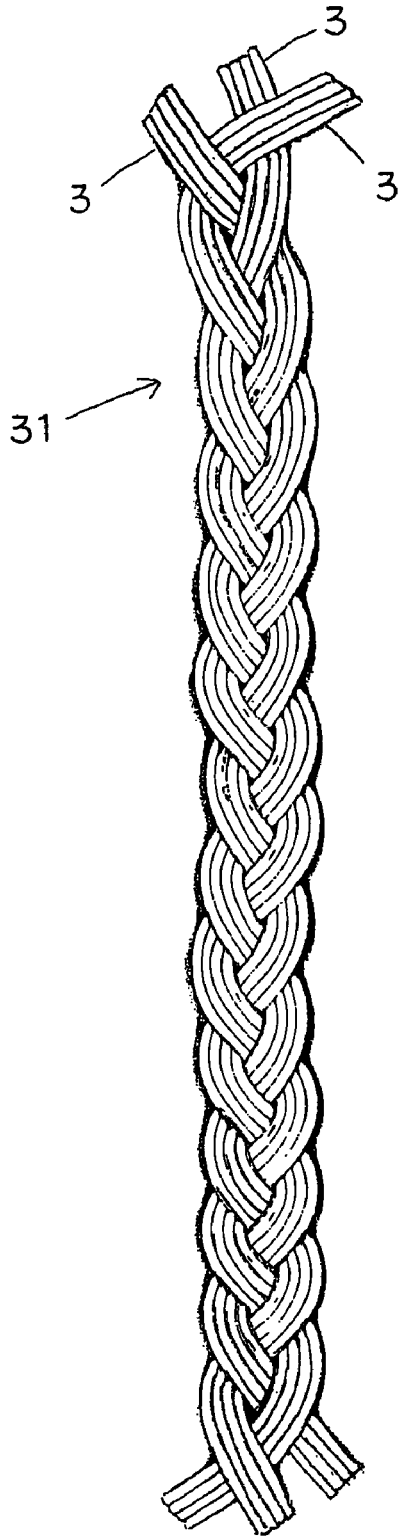
FIG. 7 is a diagram showing a light distributing yarn according to Embodiment 4.

FIG. 7 shows a light diffusing yarn 31 according to Embodiment 4. In the light diffusing yarn 31, there are used three flat yarns 3 each including four mono filaments 2 shown in FIG. 3, and the flat yarns 3 are braided together into a flat cord.

Through this braiding, twisting is imparted to each mono filament 2 at a frequency of more than one time in a length of five times as long as the diameter or width of the light diffusing yarn 31. When the light diffusing yarn 31 is bent or warped, there is scarcely any change in the relative positions of the three flat yarns 3. Further, by tightening the braiding, it is possible to maintain a satisfactory degree of proximity between the flat yarns 3.

Due to the braiding, the flat surface of each flat yarn 3 meanders along the longitudinal direction of the light diffusing yarn 31. When light enters the light diffusing yarn 31, the center axis of the conical-surface-like transmission diffusion is parallel to the tangential direction of the mono filaments 2 at the light incident portion, and hence the diffused light expands over a wide range.

When a laser beam was applied to the light diffusing yarn 31 by using a laser pointer, the diffused light expanded over a range of approximately 45 degrees.

Figure 8:
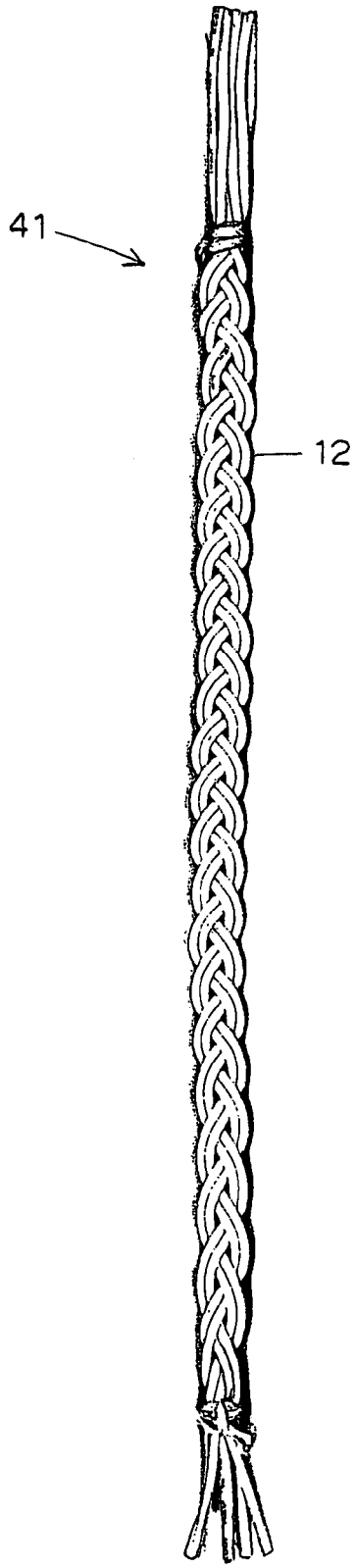
FIG. 8 is a diagram showing a light distributing yarn according to a modification of Embodiment 4.

It is also possible to form a light diffusing yarn 41 as shown in FIG. 8 by braiding together the flat yarns 12 each including two mono filaments 2 as shown in FIG. 5 instead of the flat yarns 3 each including four mono filaments 2 arranged in parallel. Further, it is also possible to use flat yarns in each of which some other number of mono filaments 2 are arranged in parallel, and it is also possible to use flat yarns in each of which a plurality of mono filaments 2 are arranged in parallel in a plurality of layers and fixed together.

The number of flat yarns braided together is not restricted to three. It is also possible to braid together two or four or more flat yarns.

Further, it is also possible to form a light diffusing yarn by braiding together, instead of flat yarns, a plurality of mono filaments 2.

EMBODIMENT 5

Figure 9:
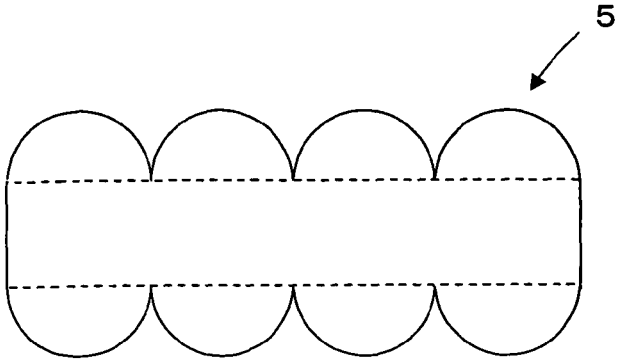
FIG. 9 is a sectional view of a flat yarn used in Embodiment 5.

As shown in FIG. 9, there was produced a flat yarn 5 having a sectional configuration in which four semi-circles are arranged close to each other on each of a pair of long sides of a rectangle. The four semi-circles on each long side of the rectangle correspond to the ridges of the present invention, each having a surface that substantially includes a mirror surface.

The flat yarn 5 can be produced by spinning out polyethylene terephthalate at a temperature, for example, of 300° C. from a mouth piece with a nozzle opening of the same configuration as the sectional configuration of the flat yarn 5 and expanding the same. It is also possible for the polyethylene terephthalate to contain approximately 3.5% by weight or less of delusterant.

It is possible to form a light diffusing yarn by using the flat yarn 5 instead of the flat yarn 3 of Embodiment 1, the flat yarn 12 of Embodiment 2, the mono filaments 2 of Embodiment 3, and the flat yarn 3 of Embodiment 4.

When applying the flat yarn 5 to Embodiment 1, it is also possible to impart twisting to the flat yarn 5 immediately after spinning it out of the mouth piece, curing it as it is through cooling.

EMBODIMENT 6

It is possible to form a surface-form structure such as woven cloth or knitted cloth having light diffusing characteristics by weaving in or knitting in one of the light diffusing yarns 1, 11, 21, 31, and 41 of Embodiments 1 through 5 as at least one of warps and wefts.

There are no limitations regarding the weaving or knitting method.

In this regard, it is possible to use one of the light diffusing yarns 1, 11, 21, 31, and 41 as both warps and wefts, or to use two of the light diffusing yarns 1, 11, 21, 31, and 41 as warps and wefts, respectively. Further, it is possible to use any one of the light diffusing yarns 1, 11, 21, 31, and 41 as solely one of warps and wefts, using some other yarn than the light diffusing yarns 1, 11, 21, 31, and 41 (including yarns of the type having no light diffusion property) as the other.

In such a surface-form structure, the light diffusing yarns 1, 11, 21, 31, and 41 used as at least one of warps and wefts generate diffused light over a wide range, and hence, by applying sunlight to this surface-form structure, it is possible to effect uniform light distribution in the room without greatly depending on the position of the sun at a given point in time, that is, independently of the movement of the position of the sun.

EMBODIMENT 7

It is possible to form a surface-form structure with light diffusion property by sewing, knitting, or embroidering any one of the light diffusing yarns 1, 11, 21, 31, and 41 of Embodiments 1 through 5 into a film-like or plate-like transparent surface-form support member or into a net-like surface-form support member.

Also in this surface-form structure, the light diffusing yarns 1, 11, 21, 31, and 41 generate diffused light over a wide range, and hence, as in Embodiment 6, it is possible to effect uniform light distribution in the room.

EMBODIMENT 8

Figure 10:
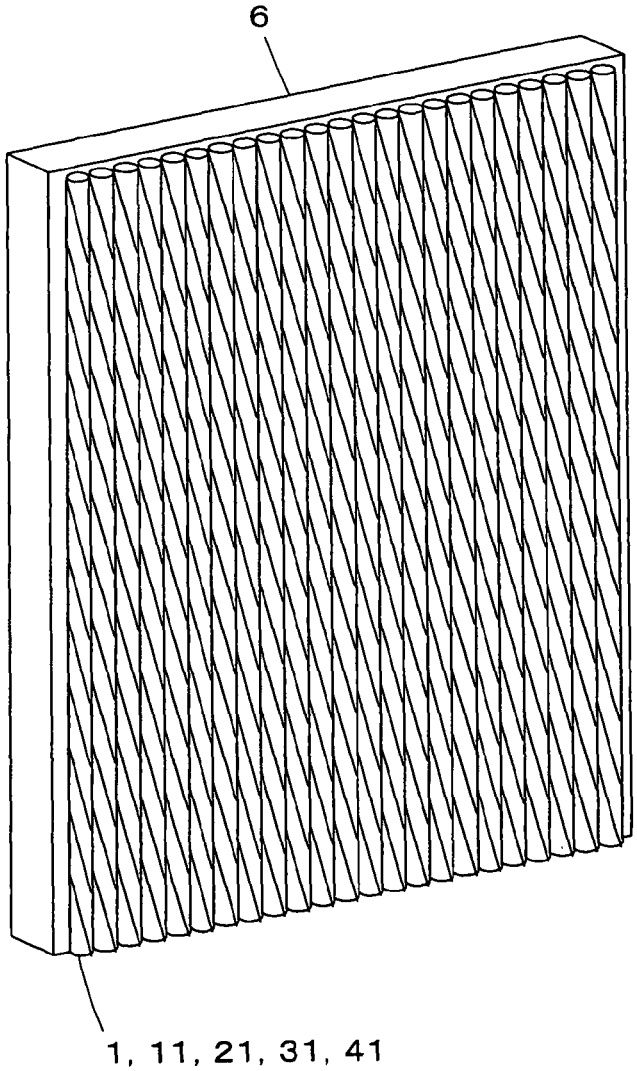
FIG. 10 is a perspective view of a surface-form structure according to Embodiment 8.

FIG. 10 shows a surface-form structure according to Embodiment 8. A large number of any one of the light diffusing yarns 1, 11, 21, 31, and 41 of Embodiments 1 through 5 described above are arranged in parallel close to each other on the surface of a transparent surface-form support member 6 and fixed thereto.

Also in this surface-form structure, the light diffusing yarns 1, 11, 21, 31, and 41 arranged and fixed generate diffused light over a wide range, and hence, as in Embodiments 6 and 7, it is possible to effect uniform light distribution in the room.

It is also possible for a large number of light diffusing yarns 1, 11, 21, 31, and 41 to be arranged and held between a pair of transparent surface-form support members 6.

EMBODIMENT 9

Figure 11:
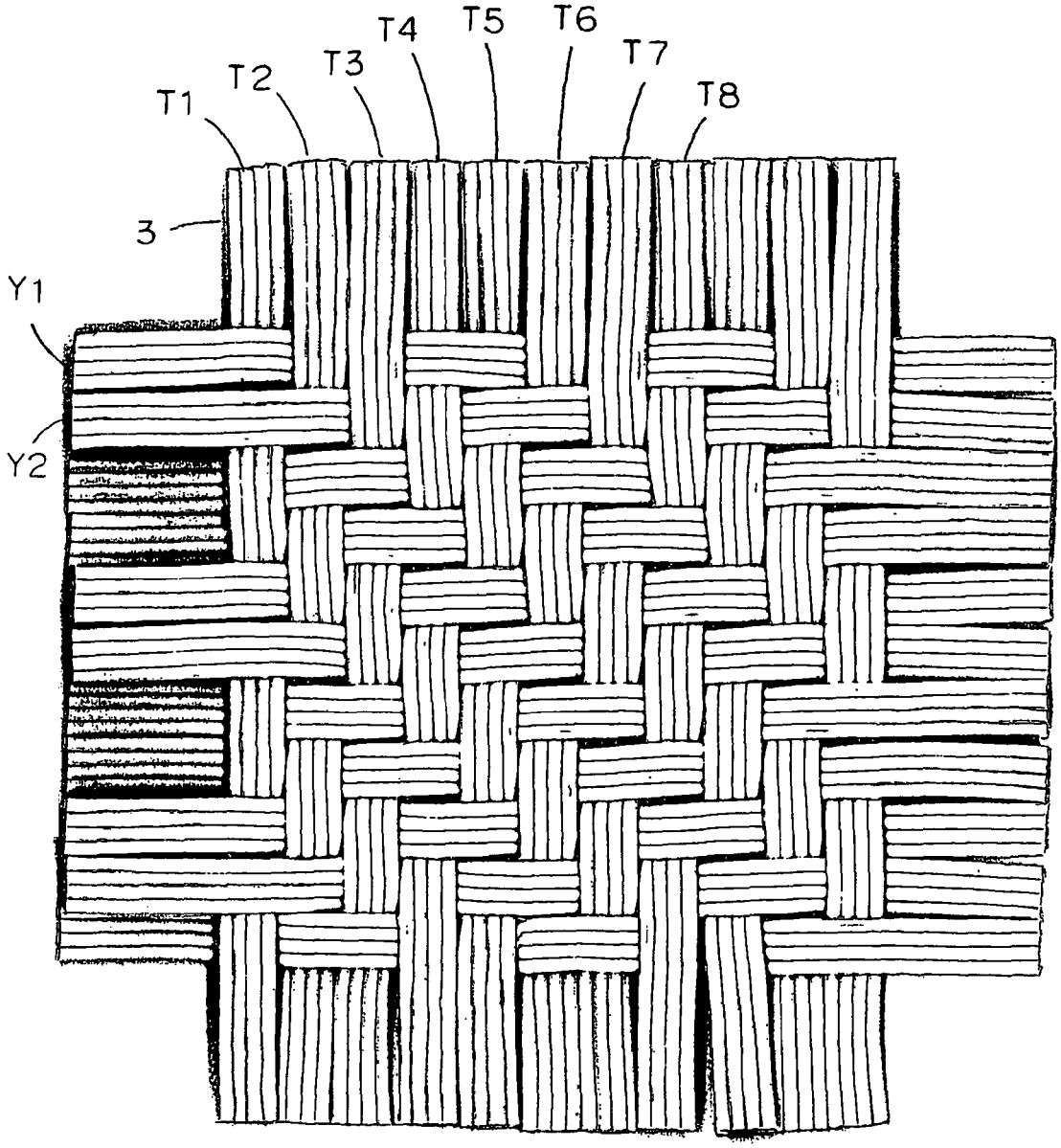
FIG. 11 is a diagram showing a surface-form structure according to Embodiment 9.

FIG. 11 shows a surface-form structure according to Embodiment 9. It is possible to obtain a cloth-like surface-form structure by weaving in the flat yarns 3 shown in FIG. 3 as the warps and wefts. In this case, the weaving is effected such that each warp passes alternately the front and back sides of the wefts for each set of a plurality of wefts, and that each weft passes alternately the front and back sides of the warps for each set of a plurality of warps. Further, the phase in which each weft passes alternately the front and back sides of the warps is shifted by one warp for each set of adjacent wefts.

That is, as shown in FIG. 11, a weft Y1 first passes the front side of a warp T1, and then passes the back sides of warps T2 and T3, and then passes the front sides of warps T4 and T5, and further, the back sides of warps T6 and T7. In this way, it passes alternately the front and back sides of each set of two warps. The next weft Y2, adjacent to the weft Y1, first passes the front sides of the warps T1 and T2, and then passes the back sides of the warps T3 and T4, and then passes the front sides of the warps T5 and T6, and further, the back sides of the warps T7 and T8. In this way, the phase in which each weft passes the front and back sides of the warps is shifted in a fixed direction by one warp for each set of adjacent wefts.

In this regard, the phase in which each weft passes the front and back sides of the warps may be shifted in a fixed direction by a predetermined plurality of warps for each set of adjacent wefts.

Due to this method of weaving, in which the phase in which each weft passes the front and back sides of the warps is shifted in a fixed direction by one or a predetermined plurality of warps for each set of adjacent wefts, sets of adjacent two warps arranged in parallel close to each other and sets of adjacent two wefts arranged in parallel close to each other, are formed at many positions. That is, the degree of proximity between the adjacent yarns increases, and the region (area) where the adjacent yarns are close to each other increases in the surface-form structure as a whole.

Figure 12:
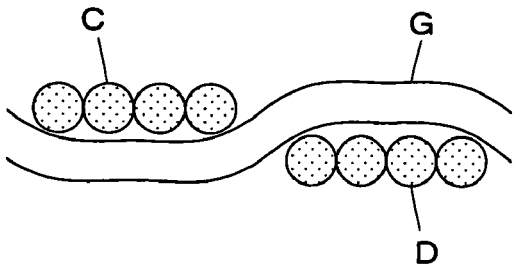
FIG. 12 is a partial sectional view of an ordinary interlacing weave.
Figure 13:
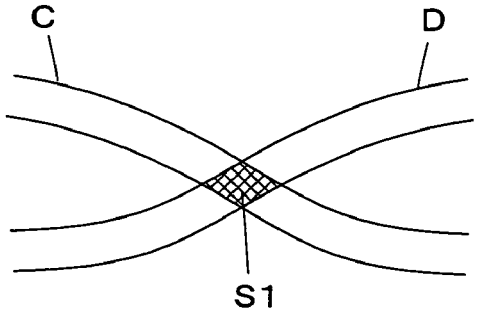
FIG. 13 is a side view of the warps C and D of FIG. 12 as seen from the right-hand side of FIG. 12.

For example, as shown in FIG. 12, in an ordinary interlacing weave, in which wefts G pass alternately the front and back sides of each of warps C and D and in which the warps C and D pass the front and back sides of each of the wefts G, the horizontal interval between the warps C and D must be at least of a value not smaller than the yarn diameter. As shown in FIG. 13, the area S1 of the proximity region of the warps C and D is very small.

Figure 14:
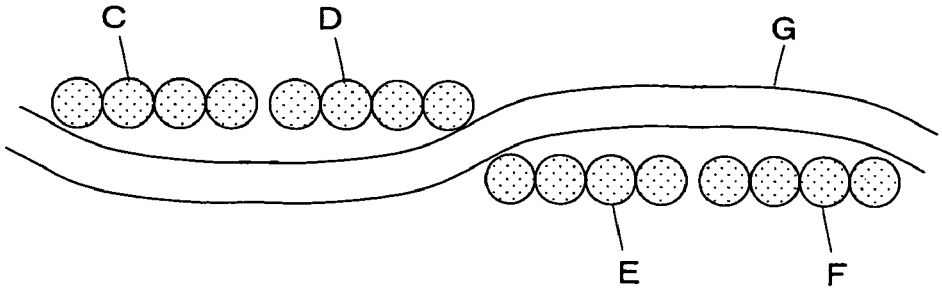
FIG. 14 is a partial sectional view illustrating how the surface-form structure of Embodiment 9 is woven.
Figure 15:
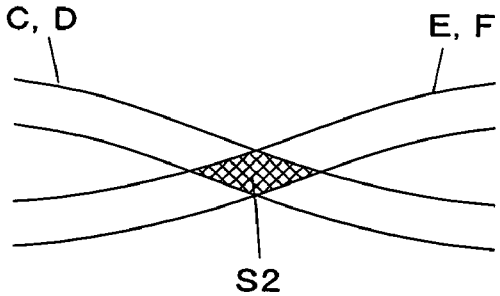
FIG. 15 is a side view of the warps C through F of FIG. 14 as seen from the right-hand side of FIG. 14.

In contrast, in the method of weaving in which, as in Embodiment 9, the phase in which each weft passes the front and back sides of the warps is shifted for each set of adjacent wefts, the horizontal interval between the warps D and E is small as shown in FIG. 14, and, in the crossing region of the warps C and D and the warps E and F, the degree of proximity between the warps C and D and the warps E and F increases, with the area S2 of the proximity region being substantially increased, as shown in FIG. 15, as compared with the area S1 in the ordinary interlacing weave of FIG. 13.

In particular, in the case in which there are used flat yarns formed by mono filaments arranged side by side or formed of a highly elastic material with a row of ridges and in which they exhibit elasticity with respect to the "tightness" or "pressure" of the weaving, the portions other than the weaving meshes swell starting from the yarns, and the degree of proximity of the adjacent yarns and the area of the proximity regions increase further. This leads to an increase in the light diffraction grating effect as described with reference to FIG. 1.

Further, as described above, in the surface-form structure of Embodiment 9, sets of two adjacent warps arranged in parallel close to each other and sets of two adjacent wefts arranged in parallel close to each other, are formed at many positions, and hence the clearances of the weaving meshes are reduced as compared with the ordinary interlacing weave. Thus, when light is introduced by using this surface-form structure, the amount of direct sunlight entering the room directly through the mesh clearances is reduced, making it possible to effect light distribution in the room while reducing glare.

Figure 16:
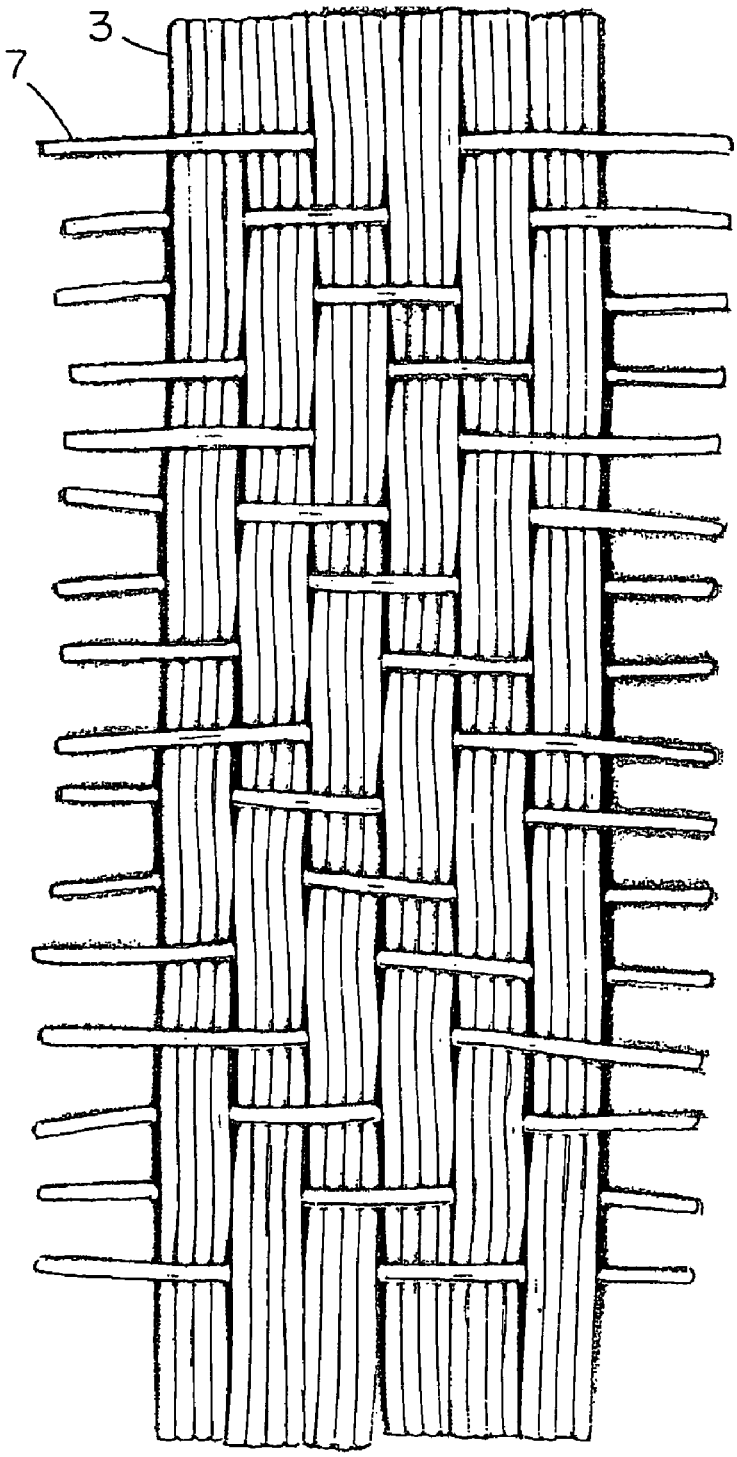
FIG. 16 is a diagram showing a surface-form structure according to a modification of Embodiment 9.
Figure 17:
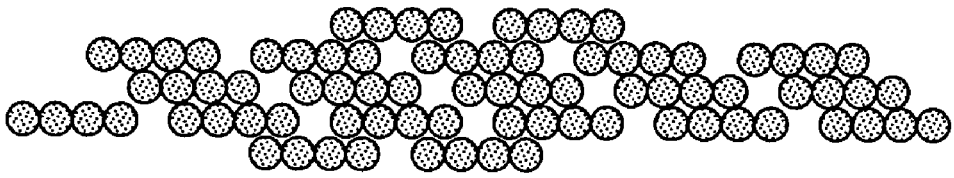
FIG. 17 is a sectional view of flat yarns used in a conventional curtain material.

While in FIG. 11 the flat yarns 3 are used as the warps and wefts, this should not be construed restrictively. For example, as shown in FIG. 16, it is also possible to use the flat yarns 3 as the warps and yarns 7 with no light diffusion property as the wefts. In this case, the wefts are used solely for the purpose of maintaining the arrangement of the warps.

Further, instead of the flat yarns 3 each including four mono filaments 2, it is also possible to use flat yarns 12 each including two mono filaments 2, or flat yarns each including some other number of mono filaments 2 arranged side by side. Further, it is also possible to weave in any one of the light diffusing yarns 1, 11, 21, 31, and 41 of Embodiments 1 through 5 described above as at least one of the warps and the wefts.

Further, it is also possible to form a woven cloth by weaving in such yarns with light diffusion property as at least one of the warps and the wefts as shown in FIG. 11 or FIG. 16.

While in the surface-form structures shown in FIGS. 11 and 16, the phase in which each weft alternately passes the front and back sides of the warps is shifted by one warp for each set of adjacent wefts, this should not be construed restrictively, and the phase in which each weft alternately passes the front and back sides of the warps may also be shifted by two warps or three warps or more for each set of adjacent wefts.

The surface-form structures of Embodiments 6 through 9 described above may also be formed so as to exhibit a cloth-like flexibility or a plate-like rigidity as a whole. It is possible to select between flexibility and rigidity according to the use of the surface-form structure.

While in Embodiments 1 through 9 described above there are used the mono filaments 2, and the flat yarns 3, 4, 5, and 12 having light transmission property are used, if the mono filaments and the flat yarns are formed of a light reflecting material, it is possible to obtain the same effects as those of Embodiments 1 through 9 except that the "conical-surface-like diffusion" is changed to a "semi-conical-surface-like diffusion". In this case, instead of the transparent surface-form support member 6 used in Embodiment 8, it is also possible to use an opaque surface-form support member.

The surface-form structures of Embodiments 6 through 9 described above are applicable to various fields of light energy utilization, such as a lighting device, a partition, a tent cloth, the roof or wall surface of a greenhouse, illuminator, and a backlight diffusion member.

EXAMPLE

After various experiments, it was found out that, when there were produced light diffusing yarns whose ridge radius was r, whose ridge-peripheral-edge angle of circumference was θ, and whose inter-ridge interval was d and which satisfy the following conditions, it is possible to obtain a degree of diffusion effect (diffraction grating effect) allowing application to various purposes by surface-form structures produced by using the light diffusing yarns.

$$r \leqq 0.0625\text{mm}$$

$$\theta \geqq 160 \text{ degrees}$$

$$d \leqq 5\mu\text{m}$$

When the mono filaments 2 are used as the ridges, the diameter D of the mono filaments 2 is in the following range:

$$D \leqq 0.125\text{mm}$$

The invention claimed is:

1. A light diffusing yarn having a predetermined diameter or width and exhibiting a light transmission property or a light reflection property, wherein a surface of the light diffusing yarn has a plurality of ridges arranged substantially in parallel and close to each other, wherein each ridge has a cross section constituting at least a part of a circle and has a surface substantially including a mirror surface, wherein the light diffusing yarn diffuses light incident on the plurality of ridges in a circular conical surface-like form or a half-circular conical surface-like form having a center axis passing through the incident point of the light and parallel to the plurality of ridges, wherein the light diffusing yarn has a twisted configuration such that a direction of a center axis of diffused light incident continuously changes along the longitudinal direction of the light diffusing yarn, and wherein a twist frequency of the twisted configuration of the light diffusing yarn is more than one twist in a length of five times the predetermined diameter or width of the light diffusing yarn.

2. A light diffusing yarn according to claim 1, wherein the ridges are formed by mono filaments exhibiting a light transmission property or a light reflection property and having a substantially circular cross section.

3. A light diffusing yarn according to claim 2, wherein the light diffusing yarn is formed of a plurality of mono filaments, the plurality of mono filaments forming a flat yarn and being arranged in a single layer or a plurality of layers and in parallel and fixed to each other, and wherein the flat yarn is twisted to form the light diffusing yarn.

4. A light diffusing yarn according to claim 3, wherein the light diffusing yarn is formed of a plurality of flat yarns twisted together.

5. A light diffusing yarn according to claim 2, wherein the light diffusing yarn is formed of a plurality of mono filaments twisted together in a bundled state.

6. A light diffusing yarn according to claim 2, wherein the light diffusing yarn is formed of a plurality of mono filaments knitted together.

7. A surface-form structure into which the light diffusing yarn according to claim 1 is woven or knitted as at least one of warps and wefts.

8. A surface-form structure comprising a surface-form support member, wherein the light diffusing yarn according to claim 1 is sewn, knitted, or embroidered into the surface-form support member.

9. A surface-form structure in which a large number of light diffusing yarns according to claim 1 are maintained substantially in parallel and close to each other.

10. A surface-form structure according to claim 9 comprising a surface-form support member, and wherein the large number of light diffusing yarns are arranged on and fixed to the surface-form support member.

11. A surface-form structure into which the light diffusing yarn of claim 1 is woven or knitted as at least one of warps and wefts, wherein each warp alternately passes the front and back sides of the wefts for each set of a plurality of wefts, and wherein each weft alternately passes the front and back sides of the warps for each set of a plurality of warps.

12. A surface-form structure according to claim 11, wherein the phase in which each weft alternately passes the front and back sides of the warps is shifted by a predetermined number of warps for each set of adjacent wefts, or wherein the phase in which each warp alternately passes the front and back sides of the wefts is shifted by a predetermined number of wefts for each set of adjacent warps.

13. A surface-form structure according to claim 11, wherein the ridges of the light diffusing yarn are formed by light transmitting or light reflecting mono filaments with a substantially circular cross section.

14. A surface-form structure according to claim 13, wherein the light diffusing yarn is a flat yarn formed of a plurality of mono filaments arranged in a single layer or a plurality of layers and in parallel and fixed to each other.

15. A surface-form structure according to claim 7 which exhibits a cloth-like flexibility.

16. A surface-form structure according to claim 7 which exhibits a plate-like rigidity.

17. A light diffusing yarn according to claim 1, wherein the twist frequency of the twisted configuration of the light diffusing yarn is approximately one twist in a length of four times as long as the predetermined diameter or width of the light diffusing yarn.

18. A light diffusing yarn according to claim 1, wherein the light diffusing yarn is formed of a plurality of mono filaments, the plurality of mono filaments forming a flat yarn having a width, and wherein the twist frequency of the twisted configuration of the light diffusing yarn is approximately one twist in a length of four times as long as the width of the flat yarn.

19. A surface-form structure into which the light diffusing yarn of claim 3 is woven or knitted as at least one of warps and wefts, wherein each warp alternately passes the front and back sides of the wefts for each set of a plurality of wefts, and wherein each weft alternately passes the front and back sides of the warps for each set of a plurality of warps.

20. A surface-form structure according to claim 19, wherein the phase in which each weft alternately passes the front and back sides of the warps is shifted by a predetermined number of warps for each set of adjacent wefts, or wherein the phase in which each warp alternately passes the front and back sides of the wefts is shifted by a predetermined number of wefts for each set of adjacent warps.

* * * * *